United States Patent [19]

Schmidt et al.

[11] Patent Number: 4,532,157

[45] Date of Patent: Jul. 30, 1985

[54] PROCESS FOR PRODUCING COLORED, RESIN-IMPREGNATED PAPER SHEETS WITH A THREE-DIMENSIONAL SURFACE STRUCTURE

[75] Inventors: Hans J. Schmidt, Haibach; Hans-Dieter Diesel, Mainhausen; Burkhard Sauer, Sulzbach, all of Fed. Rep. of Germany

[73] Assignee: Letron GmbH, Aschaffenburg, Fed. Rep. of Germany

[21] Appl. No.: 453,695

[22] Filed: Dec. 27, 1982

Related U.S. Application Data

[63] Continuation-in-part of Ser. No. 275,260, Jun. 19, 1981, abandoned.

[30] Foreign Application Priority Data

Jun. 28, 1980 [DE] Fed. Rep. of Germany ..... 3024391

[51] Int. Cl.[3] ..... B05D 3/02; B05D 5/00

[52] U.S. Cl. ..... 427/262; 427/264; 427/265; 427/288

[58] Field of Search ..... 427/257, 262, 264, 258, 427/288, 265; 428/151, 211, 153, 172

[56] References Cited

U.S. PATENT DOCUMENTS 3,406,037 10/1968 Pierce ..... 427/361
3,811,915 5/1974 Burrell et al. ..... 427/262 X
4,151,315 4/1979 Fock et al. ..... 427/288 X
4,169,907 10/1979 Barker et al. ..... 427/264

FOREIGN PATENT DOCUMENTS 2727312 12/1978 Fed. Rep. of Germany .

*Primary Examiner*—Evan K. Lawrence
*Attorney, Agent, or Firm*—Mandeville and Schweitzer

[57] ABSTRACT

A process for producing colored, resin-impregnated paper sheets with a three-dimensional surface structure. A paper sheet is printed with a pattern using aqueous printing ink. The printing ink which is printed on regions which are to have a thinner lacquer film contains a lacquer repelling material. After the printed sheet is dried, it is lacquered with an aqueous lacquer having a viscosity of 15 to 40 seconds in an AK-4 beaker. The lacquer includes as binder a mixture comprising (A) a mixture of urea and/or melamine resin, dissolved in water, and an aqueous acid as hardener, which cures in less than 100 seconds at a temperature above 100° C. after the aqueous resin solution is mixed with the acid, and (B) a binder selected from the group consisting of
  (a) water-dilutable polyester resin,
  (b) acrylate resin, and
  (c) ethoxylated derivative of glycerin, there being 10 to 250 parts by weight of solids of binder (B) for every 100 parts by weight of solids of binder (A). The lacquered sheet is cured without pressure by the action of air heated to above 100° C.

6 Claims, No Drawings

PROCESS FOR PRODUCING COLORED, RESIN-IMPREGNATED PAPER SHEETS WITH A THREE-DIMENSIONAL SURFACE STRUCTURE

This is a continuation-in-part of application Ser. No. 275,260, filed June 19, 1981, abandoned.

The invention relates to a process for producing colored resin-impregnated paper sheets with a three-dimensional surface structure by printing a pattern on the paper sheets and over-painting, the printing ink, which is printed on those regions where the paint film is thicker than in other regions, containing a paint-repelling material.

A process of the above described nature is described, inter alia, in the U.S. Pat. No. 3,811,915. It is a significant disadvantage of this process that the printed paper must be lacquered within 20 hours at the latest, as otherwise a three-dimensional pattern no longer can be retained (see Column 3, lines 59–61). There is however a need to print the paper sheets first and then to lacquer them, as required, in a separate step of the operation. One of the reasons for this is the fact that the paper sheets frequently are printed in plants other than those in which impregnating or lacquering with solutions, containing synthetic resin binders, is carried out. The printed papers can then be stored, shipped and lacquered at any time with the production of resin-impregnated paper sheets with a three-dimensional surface structure.

A different process for producing such resin-impregnated paper sheets is described in the German Auslegeschrift No. 3,024,391. In accordance with this process, the paper sheets are printed by consecutively appling several primary colors, the last primary color containing a paint-repelling material. The paper is then impregnated, if necessary, and subsequently lacquered. No details are given concerning suitable lacquers which may be used.

The invention is based on the assignment of finding a simple process, which can readily be carried out on an industrial scale, for producing impregnated paper of the type described above and which reliably leads to a three-dimensional surface structure.

It is therefore an object of the invention to provide a process wherein 1. an aqueous printing ink is used,
2. the printed sheet is dried,
3. the printed sheet is lacquered with an aqueous lacquer having a viscosity of 15 to 40 seconds in the AK-4 beaker and containing, as binder, a mixture consisting essentially of
   (A) a mixture of urea and/or melamine resin, dissolved in water, and an aqueous acid as hardener, which cures in less than 100 seconds at temperatures above 100° C. after the aqueous resin solution is mixed with the acid,
   (B) a binder selected from the group consisting of
      (a) water-dilutable polyester resin,
      (b) acrylate resin,
      (c) ethoxylated derivative of glycerin,
   there being 10 to 250 parts by weight of solids of binder (B) for every 100 parts by weight of solids of binder (A), and
4. the lacquered sheet is cured without pressure by the effects of air heated to above 100° C.

A pattern is printed on the paper sheets, as in the state of the art. When only a two-color pattern is required, it is sufficient to print a pattern in one of the colors on paper sheets having the other color. Multicolored, resin-impregnated paper sheets can however also be produced by printing paper sheets consecutively with several colors in order to achieve the desired pattern. In every case, the last printing ink must be printed on those regions where the paint film of the finished sheet is to be thinner than in the other regions. In order to achieve this, the printing ink applied last must contain a lacquer-repelling material. As described in the references mentioned above, the lacquer-repelling materials can be polysiloxanes based on silicone resins or oils. Special examples are lower alkyl silicones such as dimethyl- and diethylsilicones. Examples of such commercial products are Dri-Film 1040 of General Electric and silicone fluid 1107 of Dow Corning (registered trademarks). Lower alkyl silicones, containing a certain proportion of phenyl groups, or ester waxes (waxes based on crude lignite wax) can also be used.

Due to the fact that the printing ink, which is printed last, contains lacquer-repelling materials, the lacquer is repelled at places printed with this printing ink if the lacquering process is carried out in the suitable manner described. The paint film therefore is thinner in these places than in others and a distinct 3-dimensional surface structure such as that of a wood surface (veneer), is obtained on an impregnated paper sheet having a smooth surface. When a wood pattern is printed inventively on the impregnated paper sheets, the latter can practically not be distinguished from artificial wood veneer.

It is an essential characteristic of the process of the invention that the paper sheet is printed with an aqueous, protein-based gravure ink. The term "aqueous" is understood to mean that the liquid phase consists essentially of water. The printing ink may contain up to 30 volume percent, preferably up to 20 volume percent and most preferably up to 10 volume percent, based on the total amount of liquid phase, of aliphatic monohydric or multihydric alcohols as solubilizer. Examples of such alcohols are methanol, ethanol, ethylene glycol, propylene alcohols, glycerin, etc. Ethanol and ethylene glycol or a mixture of the two is preferred; in the mixture of ethanol and ethylene glycol, the proportion of ethylene glycol advisably is about 10 to 40 volume % and preferably about 15 to 30 volume percent.

The printing ink contains an organic binder. A preferred binder is casein. In addition, the printing ink of course contains the desired coloring pigments as well as, if necessary, the aforementioned lacquer additives, such as silicone resins or oils and special waxes.

It is a further significant characteristic of the process of the invention that the printed impregnated paper sheet is dried. The dried sheet can be stored for an extended period, that is, for weeks, months or even years. It is then processed further at any place and at any time on equipment suitable for the purpose. An aqueous lacquer, conforming to the above definition, is used for the lacquering. The essential characteristic of the process of the invention in this respect consists of the use of an aqueous lacquer. Here also, the aqueous lacquer may contain slight amounts, preferably up to 20 volume percent and particularly up to 10 volume percent, of organic solvents as solubilizer, as already described in connection with the printing ink. Suitable organic solvents for the lacquer are ethanol, glycols and methoxybutanol. It is important that the aqueous lacquer has a processing viscosity in the range of 15–30 or 15–40 seconds AK-4/20° C. and preferably in the range of 22–30 seconds. The viscosity is determined in the AK-4 beaker according to DIN 53211.

An essential component of the binder is the urea and/or melamine resin defined under (a). This is a commercially available aqueous solution of such a resin. Examples of such commercial products are (1) Maprenal MF 900=unplasticized hexamethoxymethylmelamine resin (Hoechst AG) (registered trademark)

(2) Maprenal MF 920=highly reactive, unplasticized melamine resin (Hoechst AG) (registered trademark)

(3) Methanol etherified amino resins of the Plastopal and Luwipal series (BASF) (registered trademark).

Such urea and melamine resins are cured with an aqueous acid in a manner well known to those skilled in the art. Organic and inorganic acids can be used. Examples of organic acids are p-toluenesulfonic acid or blocked p-toluenesulfonic acid. Phosphoric acid is an example of suitable inorganic acids.

It is important that the mixture of urea and/or melamine resin, dissolved in water, and the hardener acid has a long potlife at room temperature (approx. 4–8 hours) and a short potlife at elevated temperatures. At temperatures above 100° C., the lacquer mixture must therefore cure in less than 100 seconds, advisably in less than 80 seconds and preferably in less than about 60 seconds.

In order to achieve a good 3-dimensional effect, it is necessary that the lacquer contains the above-described component B in the amount given above as a binder. Preferentially, about 10 parts by weight and preferably about 20 parts by weight of binder B are used for every 100 parts by weight of solids of binder A. On the other hand, the upper limit for the amount of binder B advisably is 250 parts by weight and preferably 150 parts by weight.

An example of the acrylic resins and glycerin derivatives is the product (registered trademark)

Worléepol V 808=water-dilutable, low viscosity, highly reactive polyester resin (Worlée-Chemie GmbH)

An example of a suitable acrylic resin is

Acronal 240 D=aqueous plasticizer-free dispersion of a thermally cross-linkable copolymer based on an acrylate ester and styrene (BASF).

An example of ethoxylated glycerin derivatives is the commercial product

Softener 9=ethoxylation product of glycerin (BASF).

The same applies here also. Besides the binder, the lacquer contains suitable lacquer additives, such as plasticizers, flatting agents, defoamers and suspending agents as is well known to those skilled in the art.

The vehicle content of the lacquer is about 40 to 60 weight percent solids. The lacquer is advisably applied in an amount of 10 to 50 gram of lacquer solution per $m^2$ of impregnated paper sheet and preferably in an amount of 25 to 35 gram per $m^2$. Immediately after lacquering, the sheet is cured without pressure by the action of air heated to above 100° C. The upper limit to the temperature of the heated air is determined by the need to prevent such undesirable paint properties as bubble formation and sagging.

Drying is advisably carried out in a festoon drier, the temperature of the heated air rising up to about 160° C. In order to prepare an impregnated paper sheet with particularly good mechanical properties, it is advisable to impregnate the printed sheet, before lacquering it, with an aqueous impregnating solution having a viscosity of 15 to 30 seconds in the AK-4 beaker and containing a binder selected from the group consisting of (i) urea resins, (ii) melamine resins, (iii) polyester resins, and (iv) acrylate resins, and, immediately after impregnating it, to pass the sheet with the printed side over the roller whose surface is coated with water, to brush off the coating of water from the sheet and to dry the sheet without pressure by the action of air heated to above 100° C.

Aqueous impregnating resins, such as those known from the state of the art, can be used here as urea, melamine, polyester or acrylate resin.

For carrying out this step of the process, the paper sheet, after being impregnated with resin solution and before entering the drying zone, can be passed over a water-carrying roller running in the same or the opposite direction. The wash water, applied by the roller, together with excess impregnating resins scraped from the (printed) upper side of the impregnated sheet, for example, by means of a doctor blade. Fresh water must be added constantly and the water, containing the impregnating resin, must be discharged in order to prevent an increase in the concentration of impregnating resin in the wash water. The paper sheet, so impregnated and rinsed on the top surface, is subsequently dried. Drying brings about curing of the impregnating resin. It can be cured in the same manner as has been described above for the lacquering. Advisably however during of this impregnating resin is carried out at somewhat higher temperatures, that is, the heated air advisably has a temperature of at least about 100° C., and preferably at least about 140° C., the upper limit for the heated air lying advisably at about 180° C. and preferably at 170° C.

A particularly pronounced effect, in respect to the 3-dimensional surface, can be achieved by the lacquered sheets, immediately after the application of the lacquer and before being heated with air, are passed with the unprinted side over a heated roller having a roller surface temperature of 60° to 100° C.

The surface temperature of the heated roller is 60° to 100° C., advisably however at least 60° C., and preferably at least about 80° C. This variation of the process results in a particularly strong development of pores.

It is a particular advantage of the inventive process that impregnated paper sheets, with excellent mechanical and chemical properties can be obtained from very thin paper sheets. Paper sheets with a weight of 30 to 250 gram per $m^2$ can be used in accordance with the invention. So-called laminated papers can be used, which have not yet been impregnated with any synthetic resins.

The use of laminate papers, which are smooth on one side and are printed on this smooth side is especially preferred. The 3-dimensional surface structure becomes evident particularly strongly on the smooth side. On the other hand, the rougher side permits a better bond to the substrate, on which the impregnated paper films are applied.

The papers, used for the printing, may also be preimpregnated as are the papers manufactured in the paper mill for such printing. Such papers are commercially available under the name of "special split-resistant papers".

Before the papers are printed, the side of the papers, which is to be printed, can be passed over a so-called supercalender in order to produce a particularly smooth surface on this side.

The invention is described in the following examples. Unless stated otherwise, the quantities given are parts by weight.

| Example of Printing Inks: | | Parts by Weight |
|---|---|---|
| Printing Ink A: | Heliogen blue 7081-D (BASF) | 12.9 |
| | Neocryl BR-24 (Polyvinyl Chemie) | 19.2 |
| | Neocryl AP-2860 (Polyvinyl Chemie) | 0.2 |
| | DMAMP (I.M.C.) | 1.6 |
| | Water | 18.2 |
| | Neocryl BT-22 (Polyvinyl Chemie) | 40.0 |
| | Aquacer 502 (Cera Chemie) | 4.9 |
| | KSE Wax solution (Hoechst AG) | 3.0 |

Mixtures of the following components can be examples of lacquer solutions (impregnating solutions):

| | Parts by Weight |
|---|---|
| Impregnating solution A - Silky Luster: | |
| Plastopal BTM/97% (BASF) | 25 |
| Luwipal 063/70% (BASF) | 15 |
| Dynomin UM 15/97% (Worlee) | 25 |
| Acronal 240 D/40% (BASF) | 15 |
| 1,6-hexanediol/80% (BASF) | 12 |
| Syloid 166 (Grace) | 2.5 |
| Bentone Paste EW/5% (Kronos Titan) | 1.25 |
| Methoxybutanol (Hoechst AG) | 3 |
| Surfynol TG (Air Products USA) | 0.5 |
| Etingal A solution/10% (BASF) | 0.75 |
| Impregnating Solution B - Silky Matt: | |
| Maprenal MF 900/95% (Hoechst AG) | 32 |
| Plasticizer 9 (BASF) | 26 |
| Bentone Paste EW/5% (Kronos Titan) | 2 |
| Syloid 166 (Grace) | 4 |
| Water | 14 |
| Ethanol | 6 |
| Etingal solution/10% (BASF) | 2 |
| Zan 526 | 14 |
| Examples of Impregnating Solutions: | |
| Water-soluble polyester | 46.08 |
| Monostyrene | 4.61 |
| Conventional commercial emulsifier | 1.38 |
| Cobalt naphthenate solution | 0.47 |
| Cumene hydroperoxide | 1.38 |
| Melamine resin | 46.08 |

EXAMPLE 1

A commercially obtainable paper, weighing 60 g/m$^2$ (a commercial product of Holtzmann & Cie. AG, referred to as special split-resistant paper, 60 g/m$^2$) is printed with a wood grain pattern by the direct rotogravure process in the first printing unit using printing ink A and dried. The paper, so printed, is printed in the second inking unit with printing ink B, which contains a lacquer-repelling material. This printing ink is printed only on those areas, where pores are to be produced, and is darker than printing ink A. Printing ink B therefore basically has the same composition as printing ink A, the only differences being those described above.

Two months after being printed, the paper is lacquered on the printed side with lacquer solution A at a rate of 12 g/m$^2$, using a conventional paper lacquering machine and employing a round doctor blade for adjusting the amount applied. The lacquered paper passes through a drying tunnel, in which the air temperature increases from 100° C. at the entrance to 150° C. at the outlet of the drying tunnel. The residence time in the drying tunnel is about 40 seconds.

EXAMPLE 2

A paper weighing 70 g/m$^2$, which is commercially available from PWA Dekor GmbH+Company under the name of satinized impregnated paper, is used for the printing. This paper is printed as described in Example 1.

The printed paper is impregnated using a conventional paper impregnated installation and impregnating solution A. Excess impregnating material is removed by nip rollers, so that the paper is provided with 45 g/m$^2$ of solids of impregnating resin. Immediately afterwards, the printed side of the paper is passed over a roller running in a water bath having the temperature of the environment. By so doing, the resin on the printed side, which has not penetrated into the paper sheet, is washed off. The excess water is wiped off by a round doctor blade. Subsequently, the impregnated paper is dried in a drying tunnel in which the temperature of the surrounding air increases from 100° to 175° C. This paper sheet can be stored and shipped and is lacquered as described in Example 1.

EXAMPLE 3

A laminate paper is used weighing 220 g/m$^2$ and obtainable from Holtzmann & Cie. AG under the name of edge cardboard, smooth on one side.

This paper is finished as a 4-color printing. After colors 1 to 3 have been dried, the printing ink modified with ester wax is applied last in the fourth printing unit and dried.

After 2 months, the printed paper is subjected in a well known manner to an intensive core impregnation with impregnating solution B. Before the washing process described in Example 2 was carried out, an add-on of 70 weight percent, relative to the weight of the paper and calculated as solid resin impregnated, was achieved. The impregnated paper subsequently was passed over a water-carrying roller, as described in Example 2, and dried.

Lacquering was carried out with lacquer C (flat finish).

The amount of lacquer applied is 15 grams of the vehicle of the lacquer per m$^2$ of paper sheet. Immediately after the application of the lacquer, the paper sheet is passed over a heated roller having a surface temperature of 90° C. Subsequently, the sheet is passed through a drying tunnel with a temperature profile increasing from 80° to 170° C., the residence time being 40 seconds.

We claim:

1. Process for the manufacture of colored, impregnated lacquer coated paper sheets with a 3-dimensional surface structure, which comprises:

(a) printing a paper sheet with a pattern using an aqueous protein based gravure printing ink, the printing ink including a lacquer-repelling material, in those regions where the lacquer coating is to be thinner than in other regions;

(b) drying the printed sheet;

(c) lacquering the printed sheet with an aqueous lacquer having a viscosity of 15 to 40 seconds in the AK-4 beaker at 20° C., determined to DIN 53211, and which aqueous lacquer includes as binder a mixture comprising (A) a mixture of urea and/or melamine resin, dissolved in water, and an aqueous acid as hardener, which cures in less than 100 seconds at a temperature above 100° C. after the aqueous resin solution is mixed with the acid, and (B) a binder selected from the group consisting of (a) water-dilutable polyester resin, (b) acrylate resin, and (c) ethoxylated derivative of glycerin, there being 10 to 250 parts by weight of solids of binder (B) for every 100 parts by weight of solids of binder (A), said lacquer being repelled at places printed with printing ink containing lacquer-repelling material and the lacquer film being thinner in those places than in others; and (d) curing the lacquered sheet without pressure by the action of air heated to above 100° C.

2. Process as defined in claim 1, wherein the paper sheet, immediately after the application of the lacquer and before being heated with air, is passed with the unprinted side over a heated roller having a roller surface temperature of 60° to 100° C.

3. Process according to claim 1, wherein before the lacquering step:

(a) the dried printed sheet is impregnated with an aqueous impregnating solution having a viscosity of 15 to 30 seconds in the AK-4 beaker and containing a binder selected from the group consisting of (i) urea resins, (ii) melamine resins, (iii) polyester resins, and (iv) acrylate resins;

(b) immediately after being impregnated, the paper sheet is passed with the printed side over a roller whose surface is coated with water whereby the resin of the binder of the impregnating solution on the printed side which has not penetrated into the paper sheet is washed off;

(c) the excess water is wiped off from the sheet; and (d) the sheet is cured without pressure by the action of air heated to above 100° C.

4. Process as defined in claim 3, wherein the paper sheet, immediately after the application of the lacquer and before being heated with air, is passed with the unprinted side over a heated roller having a roller surface temperature of 60° to 100° C.

5. Process for the manufacture of colored, impregnated lacquer coated paper sheets with a 3-dimensional surface structure, which comprises:

(a) lacquering a paper sheet which was printed with a pattern using an aqueous protein based gravure printing ink, including a lacquer-repelling material, in those regions where the lacquer coating is to be thinner than in other regions and then dried, the aqueous lacquer used for lacquering the printed sheet having a viscosity of 15 to 40 seconds in the AK-4 beaker at 20° C., determined according to DIN 53211, and said aqueous lacquer including as binder a mixture comprising (A) a mixture of urea and/or melamine resin, dissolved in water, and an aqueous acid as hardener, which cures in less than 100 seconds at a temperature above 100° C. after the aqueous resin solution is mixed with the acid, and (B) a binder selected from the group consisting of (a) water-dilutable polyester resin, (b) acrylate resin, and (c) ethoxylated derivative of glycerin, there being 10 to 250 parts by weight of solids of binder (B) for every 100 parts by weight of solids of binder (A), said lacquer being repelled at places printed with printing ink containing lacquer-repelling materials and the lacquer film being thinner in those places than in others; and (b) curing the lacquered sheet without pressure by the action of air heated to above 100° C.

6. Process according to claim 5, wherein the sheet which is lacquered (a) had been impregnated with an aqueous impregnating solution having a viscosity of 15 to 30 seconds in the AK-4 beaker and containing a binder selected from the group consisting of (i) urea resins, (ii) melamine resins, (iii) polyester resins, and (iv) acrylate resins;

(b) immediately after having been impregnated, the paper sheet had been passed with the printed side over a roller whose surface was coated with water whereby the resin of the binder of the impregnating solution on the printed side which had not penetrated into the paper sheet was washed off;

(c) the excess water had been wiped off from the sheet; and (d) the sheet had been cured without pressure by the action of air heated to above 100° C.

* * * * *